US005348065A

United States Patent [19]

Meyer

[11] Patent Number: 5,348,065

[45] Date of Patent: Sep. 20, 1994

[54] CUTTER BLADE ARRANGEMENT

[75] Inventor: Scott W. Meyer, Tampa, Fla.

[73] Assignee: Iggesund Tools AB, Iggesund, Sweden

[21] Appl. No.: 948,283

[22] Filed: Sep. 22, 1992

[30] Foreign Application Priority Data

Sep. 25, 1991 [SE] Sweden ..... 9102796-1

[51] Int. Cl.[5] ..... B26D 1/12; B27G 13/00

[52] U.S. Cl. ..... 144/231; 144/230; 144/241; 407/2; 407/6; 407/46; 407/48; 407/113; 407/114

[58] Field of Search ..... 144/41, 42, 162 R, 174, 144/176, 218, 228, 229, 230, 231, 241; 407/2, 5, 6, 41, 46, 47, 48, 49, 113, 114; 83/835, 837, 840

[56] References Cited

U.S. PATENT DOCUMENTS 2,334,928 11/1943 Hollenbeck ..... 83/840
3,487,865 1/1970 Chapman et al. ..... 144/229
3,817,305 6/1974 Gibbs ..... 144/231
3,838,724 10/1974 Buchacher et al. ..... 144/230
4,151,869 5/1979 Halloran et al. ..... 144/230
4,650,408 7/1989 Carpenter et al. ..... 144/241
4,850,406 7/1989 Krautzberger ..... 144/230
4,889,025 12/1989 Collett ..... 144/241
5,146,963 9/1992 Carpenter et al. ..... 144/229

*Primary Examiner*—W. Donald Bray
*Attorney, Agent, or Firm*—Dowell & Dowell

[57] ABSTRACT

A cutting blade for working logs to timber form while simultaneously removing wood chips which includes a pair of adjacent recesses formed in the periphery of the blade. A knife is bolted in the cutting blade in a first recess and a wear insert is separately bolted to the cutting blade in the adjacent recess. The bolts are countersunk so as not to extend outwardly from the knife or wear insert.

9 Claims, 1 Drawing Sheet

CUTTER BLADE ARRANGEMENT

BACKGROUND OF THE INVENTION

1. Field of the Invention

The present invention relates to a cutter blade or cutter head arrangement by means of which logs are reduced to timber, the cutter blade including at least one knife element mounted on the head periphery adjacent a recess or gullet in the blade, so as to form a space.

2. History of the Related Art

Normally, a number of such cutting blades are assembled to form rotary cutter assemblies which are intended to remove simultaneously from several sides of the log such that should not be included in the processed timber. Simultaneously formed are wood dust, chips or other wood particles that can be used directly without needing to install a separate chip-cutting or chip-breaking machine. The entire log is converted, in this way, to timber and wood chips or shavings without requiring further processing.

In one known construction of a cutting blade of this kind, the knife or knives is/are inserted in a recess in the cutter head and are held firmly in position by a knife holder in the form of a fixed bracing structure which grips over a shoulder on the knife. This fixed bracing structure is mounted in the chip-accommodating space or gullet in the cutter blade and bolted thereto.

One drawback with this known design is that the knife holder mounted in the chip-accommodating space is subject to wear by the passing chips and is liable to be damaged to an extent which makes it difficult to loosen the knife holder thereby making a knife exchange difficult to effect.

It is also difficult to reach the bolt that is located between the cutter blades and which holds the knife holder in the chip-accommodation recess or gullet.

OBJECTION OF THE INVENTION

A main object of the present invention is to provide an arrangement of the kind defined in the introduction which will allow a knife to be attached readily and stably while enabling knives to be exchanged easily and in an uncomplicated fashion.

This and other objects of the invention together with advantages afforded thereby are achieved with an inventive arrangement having the characteristic features set forth in the following Claims.

BRIEF DESCRIPTION OF THE DRAWINGS

The invention will now be described in more detail with reference to an exemplifying embodiment thereof and also with reference to the accompanying drawing, in which.

DESCRIPTION OF THE PREFERRED EMBODIMENT

Figure 2:
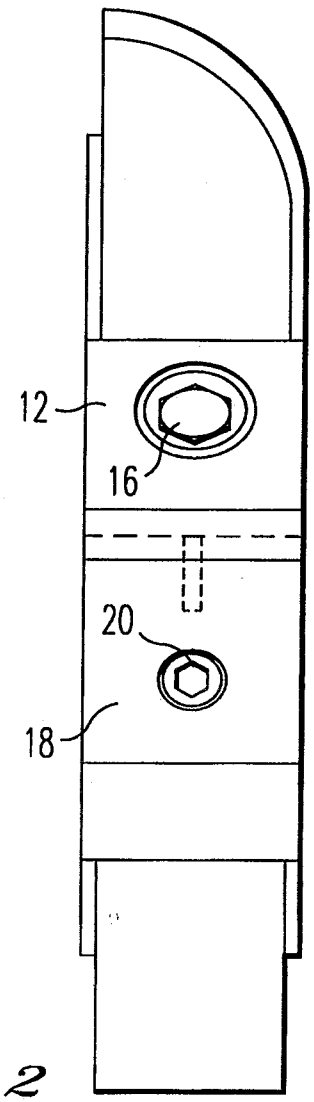
FIG. 2 is a corresponding end view.
Figure 1:
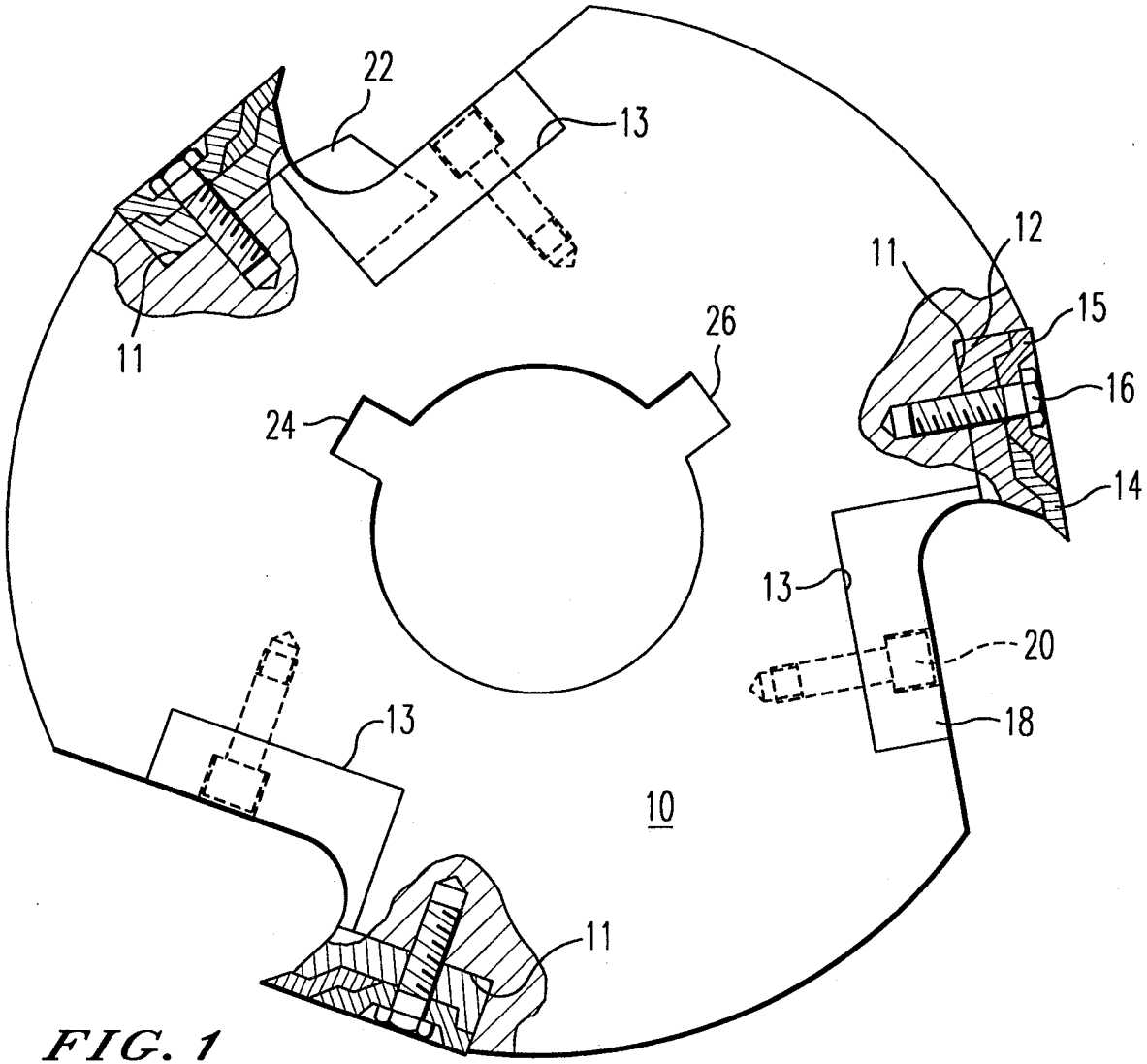
FIG. 1 is a side view of an inventive cutter provided with three knives.

The cutter blade illustrated in FIGS. 1 and 2 includes a filling piece 12 mounted in a recess 11 in the cutter blade body 10. In the illustrated embodiment, this filling piece 12 forms the bottom part of a holder cassette which firmly holds a knife or tooth 14, which is held firmly clamped between the two parts of the cassette with the aid of a bolt 16, which also secures the cassette to the cutter blade 10. Reference 15 identifies the upper part of the holder cassette. The bolt 16 is screwed into a screw hole provided in the cutter blade 10 and the bolt head is countersunk in the upper part 15 of the cassette, so as to obtain a smooth and flush surface on the cutter blade periphery. The knife 14 is of the indexable kind provided with two cutting edges and its arrangement in the cassette 12, 15 is such that the knife 14 will project slightly above the peripheral surface of the cutter blade 10, such as to remove chips from a log during log processing.

Mounted in a recess 13 in the cutter blade 10 forwardly of the knife 14, as seen in the direction of rotation of the cutter as indicated by the arrow, is a wear insert which consists of a separate, replaceable element 18 which is held firmly to the cutter blade 10 by means of a bolt 20 screwed into the cutter blade 10 and countersunk in the wear insert 18, so that no part of the wear insert 18 will protrude. The wear insert is drawn up to the lower part of the knife cassette 12, 15 at the end which faces towards the knife or tooth 14. As a result of the curved surface of the wear insert 18 and the countersunk bolt 20, the chips or wood shavings removed from a log by the knife 14 will gently follow the curvature of this surface until it leaves the cutter blade 10 at its periphery.

As illustrated in FIG. 1, the wear insert 18 may also form at its upper part a holder for a chip breaking knife 22 which functions to divide or break-up the separated chip or shavings as the chip or shaving is guided down into the chip-accommodations gullet subsequent to being removed by the knife 14.

A number of cutter blades 10 of the aforedescribed kind, for instance ten such blades, are mounted side-by-side on a common shaft (not shown) to form a cutter assembly. In order to cut the log smoothly and evenly, and also to achieve soft engagement of the knives 14 with the log, the cutting blades 10, and therewith the knives 14, are offset relative to one another in adjacent cutting blades 10, the blades being secured to the shaft with the aid of key-ways which, in accordance with the invention, are two in number and are identified in the drawing by reference numerals 24 and 26. This enables the positions of respective cutting blades 10 to be adjusted around the shaft periphery, so as to obtain the best possible division of the knives 14 around the periphery.

As will have been apparent from the aforegoing, the invention provides a cutting blade for cutter assemblies with which a simple exchange of the knives 14 is achieved in combination with a wear insert 18 which need not be removed when replacing a knife and which can be replaced separately when the need arises. The particular manner in which the knives 14 and the wear inserts 18 are mounted in the cutting blade ensures that no parts protrude that are able to influence chip formation or be worn down so as to make it difficult to exchange these parts. The wear insert 18 also forms a means for the attachment of a chip-parting knife 22 which divides or breaks-up the chip or shaving when necessary during the cutting process.

It will be understood that the invention is not restricted to the described and illustrated exemplifying embodiment thereof and that modifications and variations can be made within the scope of the following Claims.

I claim:

1. In a cutting blade for cutting logs to timber form, wherein the cutting blade includes an outer periphery having a first recess formed therein, at least one knife means mounted in the first recess in the periphery of the cutting blade, a second recess in the periphery of the cutting blade adjacent the first recess formed therein which functions to accommodate chips removed by the knife means, the improvement comprising, the knife means being secured to the cutting blade by a screw-threaded bolt means which passes through the knife means and into the cutting blade, a separate wear insert mounted with the second recess, said wear insert being removably connected to the cutting blade, each of said knife means and said wear insert having outer surfaces, said wear insert being secured to the cutting blade by second bolt means which extends through said wear insert and into the cutting blade, and each of said knife means and said wear insert having outer surfaces with a countersunk opening for said bolt means so as to provide smooth outer surfaces on said knife means and said wear insert whereby said bolt means and said second bolt means are substantially flush with said outer surfaces of said knife means and said wear insert, respectively.

2. The cutting blade according to claim 1, characterized in that the knife means includes a knife and a cassette, each cassette having inner and outer parts for clamping the knife therebetween.

3. The cutting blade according to claim 2, characterized in that the knife includes spaced cutting edges, said knife being indexable within said cassette.

4. In a cutting blade for cutting logs to timber form, wherein the cutting blade includes an outer periphery having a first recess formed therein, a knife means mounted in the first recess in the periphery of the cutting blade, a second recess in the periphery of the cutting blade adjacent the first recess formed therein which functions to accommodate chips removed by the knife means, the improvement comprising, said knife means including a knife and a cassette, each cassette having inner and outer parts for clamping said knife therebetween, said knife including spaced cutting edges, said knife being indexable within said cassette, said knife means being secured to the cutting blade by a screw-threaded bolt means which passes through the knife means, a separate wear insert mounted with the second recess, said wear insert being removably connected to the cutting blade, each of said knife means and said wear insert having outer surfaces, said wear insert being secured to the cutting blade by second bolt means which extends through said wear insert, and each of said knife means and said wear insert having outer surfaces with a countersunk opening for said bolt means so as to provide smooth outer surfaces on said knife means and said wear insert whereby said bolt means and said second bolt means are substantially flush with said outer surfaces of said knife means and said wear insert, respectively.

5. The cutting blade according to claim 4 characterized in that a chip-parting knife is mounted in said second recess to divide the chips removed by the knife means.

6. The cutting blade according to claim 5, characterized in that the chip-parting knife is held firmly to the cutting blade by the wear insert.

7. The cutting blade according to claim 5 characterized in that the knife means projects forward over one end of the wear insert.

8. The cutting blade according to claim 7, characterized in that a plurality of cutting blades are disposed on a common shaft with the aid of the key-ways, formed in the cutting blades wherein each cutting blade has at least one key-way which is offset in relation to the key-way in adjacent cutting blades around the circumference of a shaft hole.

9. The cutting blade according to claim 8, characterized in that each cutting blade has at least two key-ways which are offset relative to one another around the circumference of the shaft hole.

* * * * *